US007708567B2

(12) United States Patent
Tokunaga

(10) Patent No.: US 7,708,567 B2
(45) Date of Patent: May 4, 2010

(54) CONNECTOR HAVING A PLURALITY OF CONNECTOR MODULES AND A HOUSING THAT HOLDS SAID PLURALITY OF CONNECTOR MODULES WITH A GAP BETWEEN ADJACENT ONES THEREOF

(75) Inventor: Takashi Tokunaga, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/353,338

(22) Filed: Jan. 14, 2009

(65) Prior Publication Data

US 2009/0186533 A1 Jul. 23, 2009

(30) Foreign Application Priority Data

Jan. 17, 2008 (JP) ..... 2008-008274

(51) Int. Cl.
*H01R 13/502* (2006.01)

(52) U.S. Cl. ..... 439/79; 439/76.1

(58) Field of Classification Search ..... 439/79–80, 439/701, 676

See application file for complete search history.

(56) References Cited

U.S. PATENT DOCUMENTS 6,267,604 B1 * 7/2001 Mickievicz et al. ..... 439/79
6,638,079 B1 * 10/2003 Billman et al. ..... 439/76.1
6,655,966 B2 * 12/2003 Rothermel et al. ..... 439/76.1
6,666,692 B2 * 12/2003 Billman et al. ..... 439/76.1
6,749,468 B2 * 6/2004 Avery ..... 439/701
6,890,215 B2 * 5/2005 Lang et al. ..... 439/607.35

FOREIGN PATENT DOCUMENTS

JP 2005-516375 A 6/2005

* cited by examiner

*Primary Examiner*—Michael C Zarroli
(74) *Attorney, Agent, or Firm*—Frishauf, Holtz, Goodman & Chick, P.C.

(57) ABSTRACT

A connector which is capable of preventing crosstalk from occurring when a plurality of pairs of differential signal transmission contacts are arranged in a horizontal row. A housing holds a plurality of connector modules with a gap between adjacent ones thereof. Each connector module is comprised of a plate-shaped holding member, a plurality of first signal contacts held on one surface of the holding member, and a plurality of second signal contacts held on the other surface of the holding member. Positions of the respective first signal contacts of the plurality of connector modules, and positions of associated ones of the second signal contacts of the connector modules are made approximately coincident with each other in the direction of the height of the housing, respectively.

6 Claims, 5 Drawing Sheets

CONNECTOR HAVING A PLURALITY OF CONNECTOR MODULES AND A HOUSING THAT HOLDS SAID PLURALITY OF CONNECTOR MODULES WITH A GAP BETWEEN ADJACENT ONES THEREOF

BACKGROUND OF THE INVENTION

1. Field of the Invention

This invention relates to a connector, and more particularly to a connector suitable for transmission of differential signals.

2. Description of the Related Art

Conventionally, there has been proposed a connector assembly provided with a header and a receptacle (see e.g. Japanese PCT application translation Publication No. 2005-516375).

The header includes a header-side insulating housing, a plurality of pairs of header contacts, and a plurality of ground shield contacts. The header-side insulating housing has a base portion and a pair of side walls. The base portion is substantially plate-shaped. The pair of side walls are each substantially plate-shaped, and are connected to side portions of the base portion.

The plurality of pairs of header contacts form a plurality of pairs of differential signal transmission contacts, and are arranged in matrix on the base portion of the header-side insulating housing. Each header contact includes a connecting portion and a contact portion. The connecting portion is connected to a first circuit board, which forms one object to be connected.

The plurality of ground shield contacts are arranged on the base portion of the header-side insulating housing such that they are each adjacent to associated ones of the pairs of header contacts, respectively. Each ground shield contact includes a plate portion and a connecting portion. The plate portion is opposed to an associated one of the pairs of header contacts. The connecting portion is connected to a ground of the first circuit board.

The receptacle includes a receptacle-side insulating housing and a plurality of module terminals.

The receptacle-side insulating housing is substantially in the form of a casing, and includes a plurality of slots. The slots receive the module terminals whereby the module terminals are held by the receptacle-side insulating housing.

The module terminals each include an overmolded portion, a plurality of pairs of receptacle contacts, and a shield.

The overmolded portion includes a pair of insulating layers and a front edge. The pair of insulating layers are each substantially plate-shaped, and are opposed to each other with a space therebetween. The front edge is connected to front ends of the pair of insulating layers. In the front edge, openings are formed at equally-spaced intervals.

Each receptacle contact includes a contact portion, a press-fit portion, and an intermediate portion. The contact portion is formed at one end of the receptacle contact, and protrudes from the overmolded portion via an associated one of the openings formed in the front edge of the overmolded portion, until the contact portion comes into contact with an associated one of the pairs of header contacts of the header. The press-fit portion is press-fitted into a through hole of a second circuit board, which is the other object to be connected, and is connected to the second circuit board. The intermediate portion connects the contact portion and the press-fit portion. The intermediate portion is accommodated in the space of the overmolded portion.

The shield is substantially plate-shaped, and includes contact portions. The contact portions are each brought into contact with a plate portion of an associated one of the ground shield contacts of the header. The shield is mounted on an outer surface of one of the insulating layers of the overmolded portion.

When the receptacle-side insulating housing that holds the module terminals of the receptacle mounted on the second circuit board is inserted into the header-side insulating housing of the header mounted on the first circuit board, the contact portions of the receptacle contacts of the module terminals are brought into contact with the associated contact portions of the header contacts, and contact portions of the shields of the module terminals are brought into contact with the associated plate portions of the ground shield contacts of the header. As a consequence, signal transmission lines of the first circuit board, and signal transmission lines of the second circuit board are connected by the header contacts and the receptacle contacts, and the grounds of the first circuit board and grounds of the second circuit board are connected by the ground shield contacts and shield contacts.

According to the above-described connector, in the module terminals, the plurality of pairs of receptacle contacts, which form the plurality of pairs of differential signal transmission contacts, are arranged along the direction of the height of the receptacle-side insulating housing (direction parallel to the direction of the thickness of the second circuit board on which the module terminals are mounted). That is, the differential signal transmission contacts that form pairs are arranged in so-called vertical rows. However, when the pairs of differential signal transmission contacts are arranged in vertical rows, there arise problems such as generation of a skew and miss matching of differential impedance. Therefore, when differential signals are transmitted in a high frequency band, it is more advantageous to arrange the receptacle contacts, which form pairs of differential signal transmission contacts, along the direction of arrangement of the module terminals (arrange them in so-called horizontal rows).

To arrange the pairs of differential signal transmission contacts in horizontal rows, it is required to eliminate the shields of the module terminals. However, if the shields are eliminated, a gap is formed between each pair of differential signal transmission contacts, which weakens the connection between the pair of differential signal transmission contacts, whereby the degree of togetherness thereof makes no difference from the degree of togetherness of each differential signal transmission contact as one of each pair and each differential signal transmission contact as one of each another pair adjacent to the pair in the horizontal row. This causes crosstalk between one pair of differential signal transmission contacts and another pair of differential signal transmission contacts adjacent to the one pair.

SUMMARY OF THE INVENTION

The present invention has been made in view of these circumstances, and an object thereof is to provide a connector which is capable of preventing crosstalk from occurring when a plurality of pairs of differential signal transmission contacts are arranged in a horizontal row.

To attain the above object, the present invention provides a connector comprising a plurality of connector modules, each of the connector modules including a plate-shaped holding member, a plurality of first contacts held on one surface of the holding member, and a plurality of second contacts held on the other surface of the holding members, positions of respective associated ones of the first and second contacts of the connector modules approximately being coincident with each other in a direction of height of the housing, and a housing that holds the plurality of connector modules such that the plurality of connector modules are arranged with a gap between each adjacent ones thereof.

With the arrangement of the connector according to the present invention, the plurality of first contacts are held on the one surface of the holding member of the connector module, and the plurality of second contacts are held on the other surface of the holding member. Further, positions of respective associated ones of the first and second contacts of the connector modules approximately coincide with each other in a direction of height of the housing. Therefore, in each individual connector module, the first contacts held on the one surface of the holding member, and associated ones of the second contacts held on the other surface of the holding member are strongly connected to each other.

On the other hand, the housing holds the plurality of connector modules such that the connector modules are each arranged with a gap between adjacent ones thereof, and hence the connection between the first and second contacts of one of the connector modules, and the first and second contacts of another connector module adjacent to the one connector module in the arrangement direction of the connector modules is weak.

Preferably, the housing includes a plurality of partition walls that divide an inner space of the housing into a plurality of slots into which portions of the respective connector modules are inserted, and spaces formed in the respective partition walls are located between portions of the first contacts of one connector module, and corresponding portions of the second contacts of the other connector module, the one and the other connector modules being adjacent to each other in a direction of arrangement of the connector modules.

Preferably, the first and second contacts are both signal contacts, first ground contacts being each held between adjacent ones of the first contacts on the one surface of the holding member, second ground contacts being each held between adjacent ones of the second contacts on the other surface of the holding member.

Preferably, each of the first contacts held on the one surface of the holding member, and an associated one of the second contacts held on the other surface of the holding member, the first contact and the associated second contact being coincident in position in the direction of the height of the housing, form a pair of differential signal transmission contacts.

According to the present invention, it is possible to prevent crosstalk from occurring when a plurality of pairs of differential signal transmission contacts are arranged in a horizontal row.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
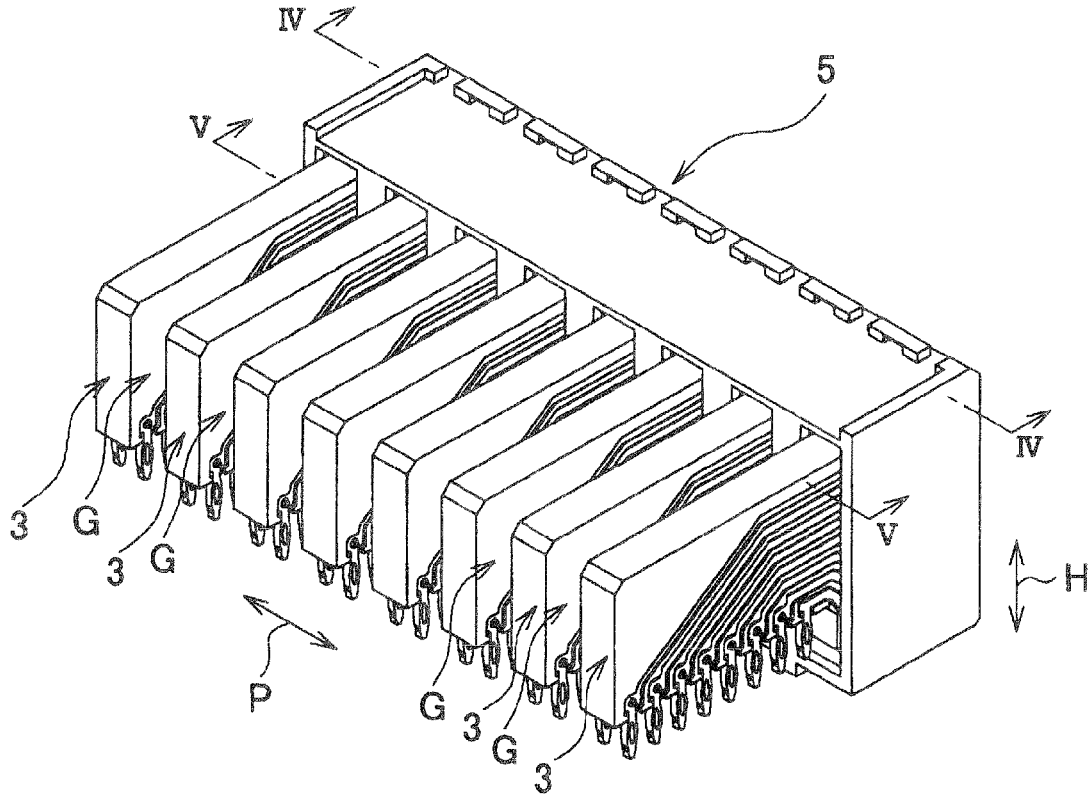
FIG. 1 is a perspective view of a connector according to an embodiment of the present invention.
Figure 2:
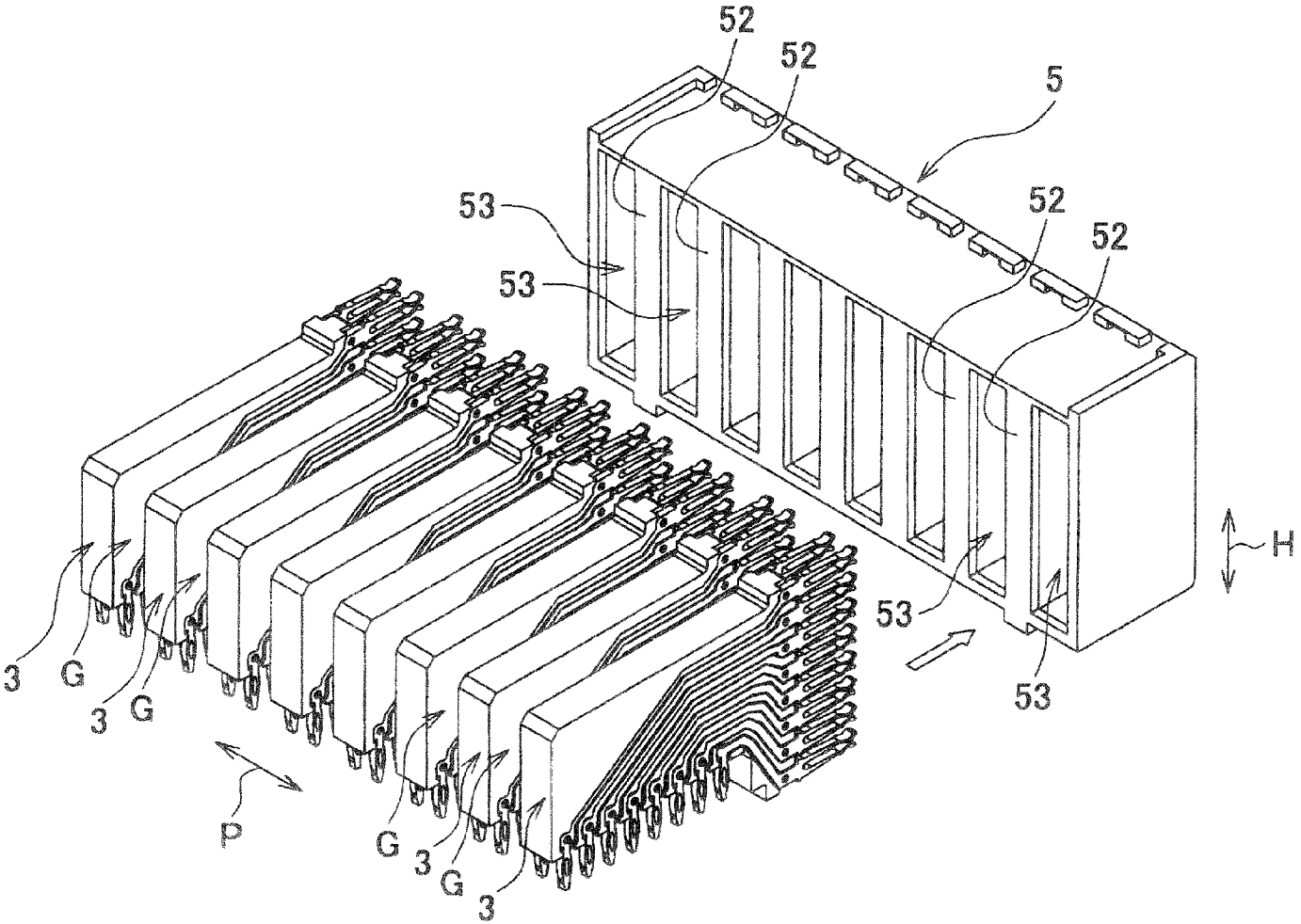
FIG. 2 is an exploded perspective view of the connector shown in FIG. 1.

As shown in FIGS. 1 and 2, the connector is comprised of a plurality of connector modules 3 and a housing 5.

Figure 3:
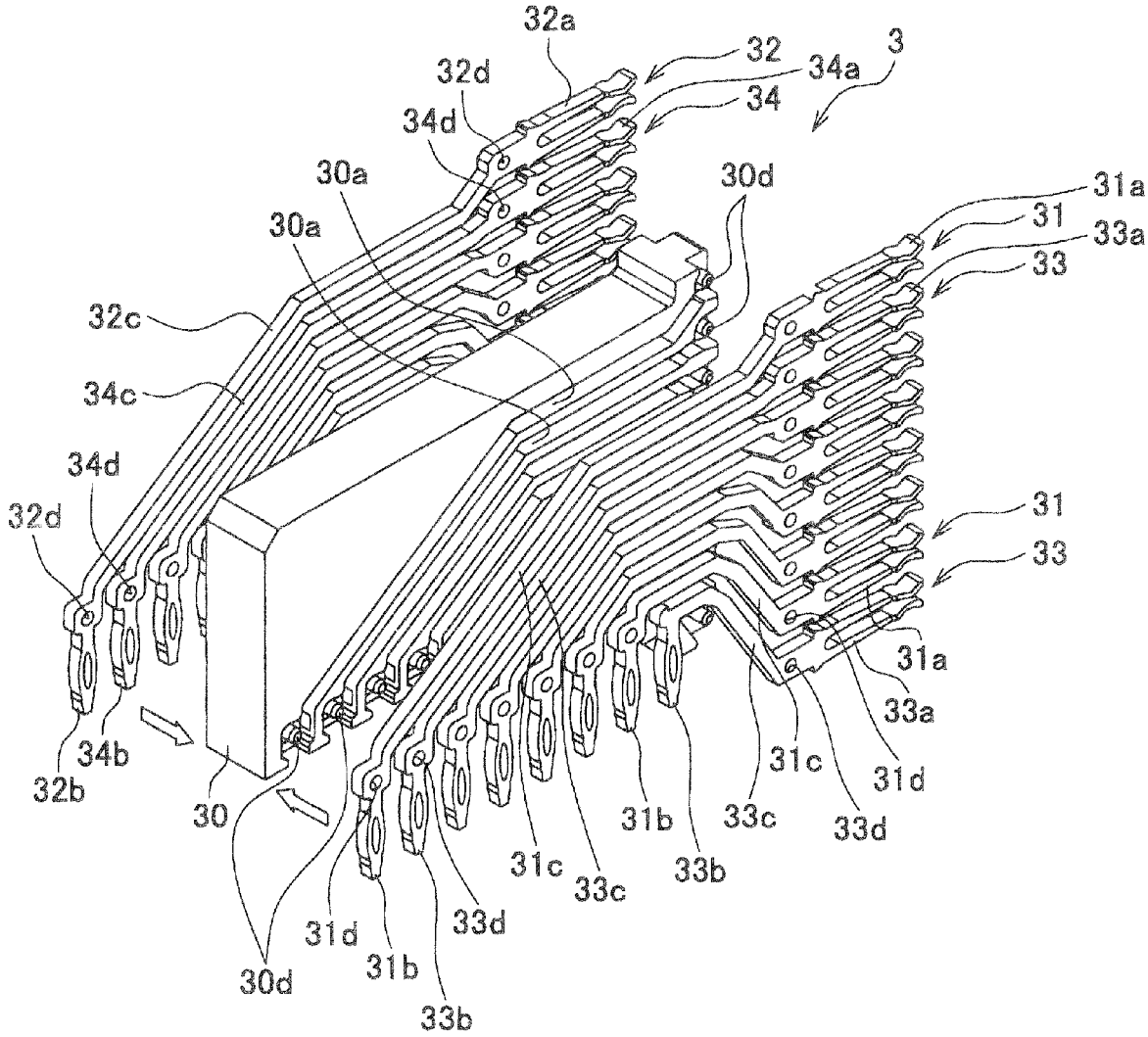
FIG. 3 is an exploded perspective view of a connector module of the connector shown in FIG. 1.
Figure 4:
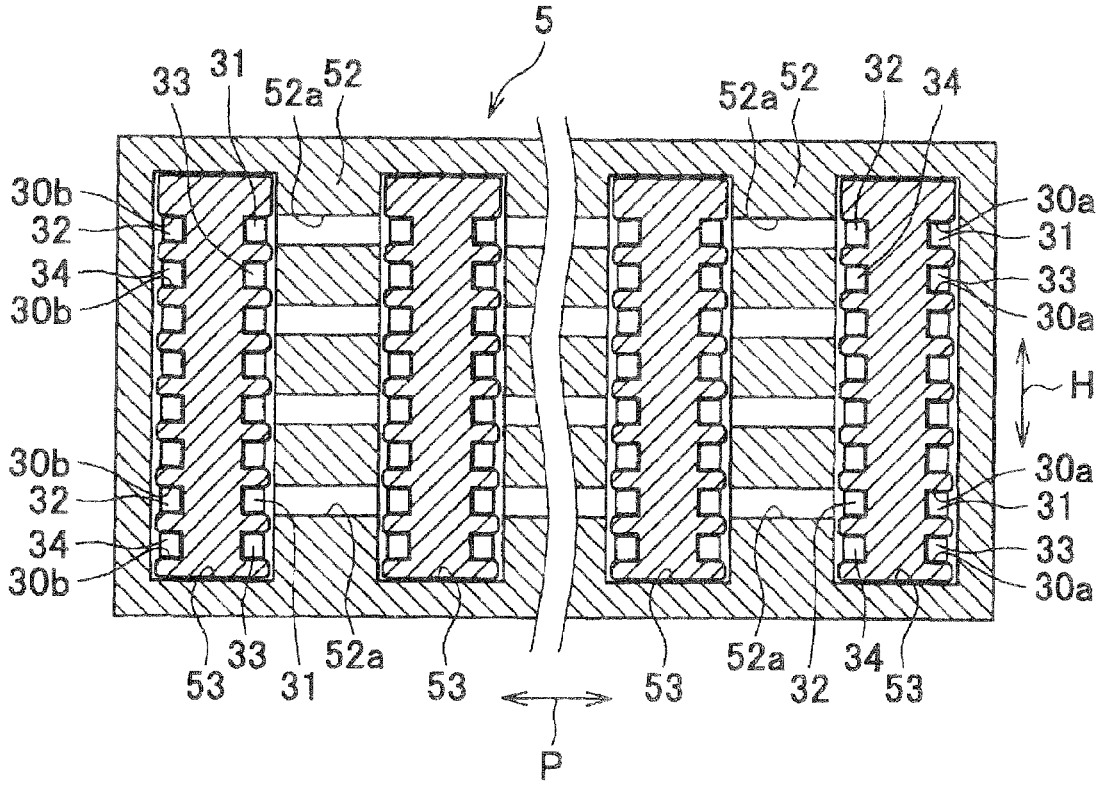
FIG. 4 is a cross-sectional view taken on line IV-IV of FIG. 1.

As shown in FIG. 3, each connector module 3 includes a holding member 30, a plurality of first signal contacts (first contacts) 31, a plurality of second signal contacts (second contacts) 32, a plurality of first ground contacts 33, and a plurality of second ground contacts 34.

The holding member 30 is substantially plate-shaped, and is made of an insulating material. The holding member 30 has one surface formed with a plurality of first holding grooves 30*a*, and the other surface formed with a plurality of second holding grooves 30*b* (see FIG. 5). The first and second holding grooves 30*a* and 30*b* are in a back-to-back positional relationship with respect to the holding member 30 therebetween.

Each first signal contact 31 is a signal contact, and includes a contact portion 31*a*, a press-fit portion 31*b*, and a connecting portion 31*c*. The contact portion 31*a* is formed at one end of the first signal contact 31, and is in contact with a first signal contact of a daughter card, not shown. The press-fit portion 31*b* is formed at the other end of the first signal contact 31, and is press-fitted into a through hole communicating with a signal conductive path of a back plane, not shown. The connecting portion 31*c* connects between the contact portion 31*a* and the press-fit portion 31*b*. When the connecting portion 31*c* is inserted into an associated one of the first holding grooves 30*a* of the holding member 30, associated ones of protrusions 30*d* of the holding member 30 are press-fitted into press-fit portions (through holes) 31*d* of the first signal contact 31, and hence the first signal contact 31 is held on the one surface of the holding member 30.

Each second signal contact 32 is a signal contact, and includes a contact portion 32*a*, a press-fit portion 32*b*, and a connecting portion 32*c*. The contact portion 32*a* is formed at one end of the second signal contact 32, and is in contact with a second signal contact of the daughter card, not shown. The press-fit portion 32*b* is formed at the other end of the second signal contact 32, and is press-fitted into a through hole communicating with the signal conductive path of the back plane, not shown. The connecting portion 32*c* connects between the contact portion 32*a* and the press-fit portion 32*b*. When the connecting portion 32*c* is inserted into an associated one of the second holding grooves 30*b* of the holding member 30, associated ones of protrusions (not shown) formed in the associated second holding groove 30*b* of the holding member 30 are press-fitted into press-fit portions (through holes) 32*d* of the second signal contact 32, and hence the second signal contact 32 is held on the other surface of the holding member 30.

In each individual connector module 3, one of the first signal contacts 31 held on the one surface of the holding member 30, and an associated one of the second signal contacts 32 held on the other surface of the holding member 30 are in a back-to-back positional relationship, and form a pair of differential signal transmission contacts. The first signal contact 31 and the associated second signal contact 32 forming the pair of differential signal transmission contacts are arranged in a so-called horizontal row via the holding member 30, so that the togetherness therebetween is strong.

On the other hand, the housing 5 holds the plurality of connector modules 3 such that adjacent ones of the connector modules 3 are arranged with a gap G (see FIGS. 2 and 5) therebetween, and hence the togetherness between the first signal contacts 31 of one connector module 3 and the second signal contacts 32 of another connector module 3 adjacent to the one connector module 3 in the arrangement direction P of the connector modules 3 (see FIGS. 2 and 5) is weak.

Each first ground contact 33 includes a contact portion 33*a*, a press-fit portion 33*b*, and a connecting portion 33*c*. The contact portion 33*a* is formed at one end of the first ground contact 33, and is in contact with a ground of the daughter card, not shown. The press-fit portion 33*b* is formed at the other end of the first ground contact 33, and is press-fitted into a through hole communicating with a ground of the back plane, not shown. The connecting portion 33*c* connects between the contact portion 33*a* and the press-fit portion 33*b*. When the connecting portion 33*c* is inserted into an associated one of the first holding grooves 30*a* of the holding member 30, associated ones of the protrusions 30*d* of the holding member 30 are press-fitted into press-fit portions (through holes) 33*d* of the first ground contact 33, and hence the first ground contact 33 is held on the one surface of the holding member 30.

The first signal contacts 31 and the first ground contacts 33 are alternately arranged along the direction H of the height of the housing 5.

Each second ground contact 34 includes a contact portion 34*a*, a press-fit portion 34*b*, and a connecting portion 34*c*. The contact portion 34*a* is formed at one end of the second ground contact 34, and is in contact with the ground of the daughter card, not shown. The press-fit portion 34*b* is formed at the other end of the second ground contact 34, and is press-fitted into a through hole communicating with the ground of the back plane, not shown. The connecting portion 34*c* connects between the contact portion 34*a* and the press-fit portion 34*b*. When the connecting portion 34*c* is inserted into an associated one of the second holding grooves 30*b* of the holding member 30, associated ones of the protrusions (not shown) formed in the second holding groove 30*b* of the holding member 30 are press-fitted into press-fit portions (through holes) 34*d* of the second ground contact 34, and hence the second ground contact 34 is held on the other surface of the holding member 30.

The second signal contacts 32 and the second ground contacts 34 are alternately arranged along the direction H of the height of the housing 5.

Figure 5:
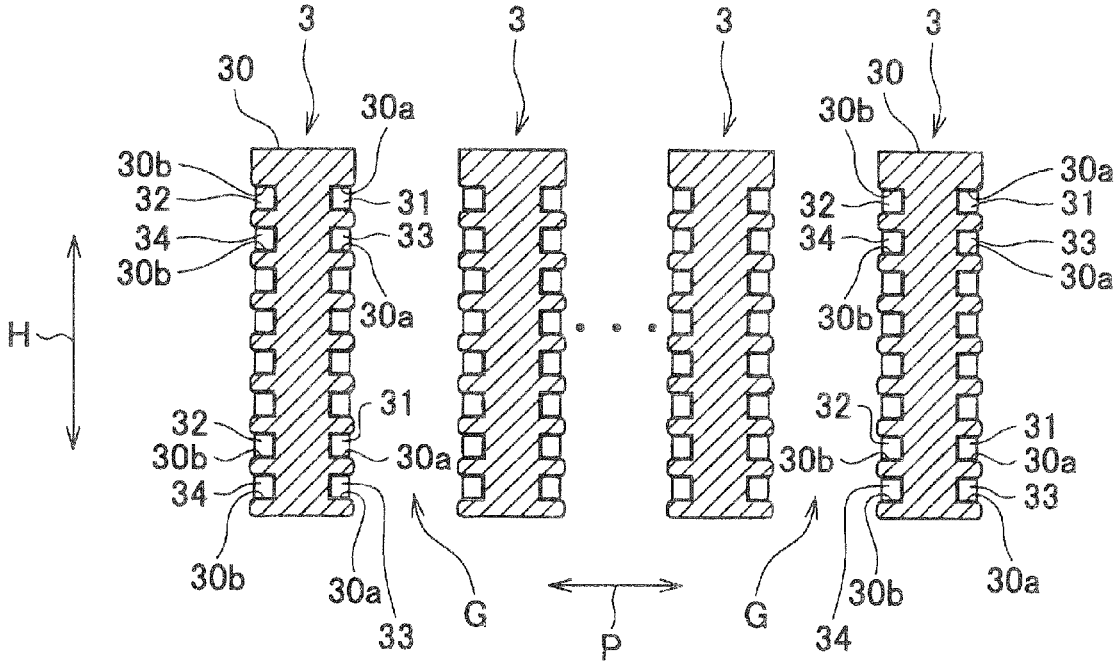
FIG. 5 is a cross-sectional view taken on line V-V of FIG. 1.

The housing 5 is substantially in the form of a casing, and is made of an insulating material. As shown in FIGS. 2 and 5, the housing 5 includes a plurality of slots 53 and a plurality of partition walls 52. Each slot 53 receives part of an associated one of the connector modules 3. The partition walls 52 are interposed between adjacent ones of the slots 53. When all the connector modules 3 are inserted into associated ones of the slots 53, the connector modules 3 are held by the housing 5 in a state arranged at equally-spaced intervals with the gap G therebetween. The partition walls 52 are each formed with through holes (spaces) 52*a*. The through holes 52*a* are arranged between the contact portions 31*a* of the first signal contacts 31 of one connector module 3, and the contact portions 32*a* of the second signal contacts 32 of another connector module 3 that is adjacent to the one connector module 3 in the arrangement direction P of the connector modules 3.

The connector is mounted on the back plane, not shown. The connector modules 3 are inserted into the associated slots 53 of the housing 5 of the connector for causing the housing 5 to hold the connector modules 3, whereby the back plane and the daughter card are electrically connected to each other via the connector. It should be noted that the contact portions 31*a* of the first signal contacts 31, the contact portions 32*a* of the second signal contacts 32, the contact portions 33*a* of the first ground contacts 33, and the contact portions 34*a* of the second ground contacts 34 are inserted into contact portion-accommodating portions, not shown, of the housing 5.

When the back plane and the daughter card, neither of which is shown, are electrically connected to each other via the connector, differential signal transmission is performed therebetween. In this case, in each connector module 3, one of the first signal contacts 31 and an associated one of the second signal contacts 32, which form a pair of differential signal transmission contacts, are arranged adjacent to each other via the holding member 30 in the arrangement direction P of the connector modules 3 (one of the first signal contacts 31 and an associated one of the second signal contacts 32, which form a pair of differential signal transmission contacts, are arranged back-to-back via the holding member 30), so that the togetherness between each first signal contacts 31 and the associated second signal contact 32 is strong. This results in reduced crosstalk and external noise. On the other hand, the plurality of connector modules 3 are arranged at equally-spaced intervals with the gap G therebetween, and therefore the togetherness between the first signal contacts 31 of one of two adjacent connector modules 3, and associated second signal contacts 32 of the other of the adjacent connector modules 3 is weak. This results in prevention of crosstalk between pairs of differential signal transmission contacts formed in one connector module 3, and pairs of differential signal transmission contacts formed in another connector module that is adjacent to the one connector module in the arrangement direction P of the connector modules 3.

Further, since the partition walls 52 are each formed with the through holes 52*a*, it is possible to suppress the partition wall 52 from increasing the togetherness of the contact portion 31*a* of each first signal contact 31 of one connector module 3 and the contact portion 32*a* of each corresponding second signal contact 32 of another connector module 3 that is adjacent to the one connector module 3 in the arrangement direction P of the connector modules 3.

Furthermore, since the first and second ground contacts 33 and 34 are arranged, it is possible to further prevent crosstalk between pairs of differential signal transmission contacts of one of adjacent connector modules 3, and pairs of differential signal transmission contacts of the other of the adjacent connector modules 3.

Further, each first signal contact 31 and an associated one of the second signal contacts 32, which form a pair of differential signal transmission contacts, are arranged in a horizontal row, and hence it is possible to form contacts equal in shape and length, whereby the problems of generation of a skew, miss matching of differential impedance, etc. can be made difficult to arise. This is preferable to transmit differential signals at a high frequency band.

It should be noted that although in the present embodiment, the respective protrusions 30*d* of the first and second holding grooves 30*a* and 30*b* are press-fitted into associated ones of the press-fit portions 31*d*, 33*d*, 32*d*, and 34*d* of the first signal contacts 31, the first ground contacts 33, the second signal contacts 32, and the second ground contacts 34, for causing the first signal contacts 31, the first ground contacts 33, the second signal contacts 32, and the second ground contacts 34 to be held by the holding member 30, respectively, this is not limitative, but the first signal contacts 31, the first ground contacts 33, the second signal contacts 32, and the second ground contacts 34 may be bonded or welded to associated ones of the first and second holding grooves 30*a* and 30*b*.

Alternatively, the contacts 31 to 34 and each connector module 3 may be integrally formed with each other by a mold-in molding method.

Further, although in the present embodiment, the first ground contacts 33 and the second ground contacts 34 are used, they may not be used.

It should be noted that although in the present embodiment, the housing 5 includes the partition walls 52, the partition walls 52 are not required provided that the housing 5 is capable of holding a plurality of connector modules 3 with the gap G between the connector modules.

Further, although in the present embodiment, the through holes 52*a* are formed in the partition walls 52 as spaces, the spaces are not limited to the through holes 52*a*, but they may be formed by cutouts, grooves, or cavities.

It is further understood by those skilled in the art that the foregoing are the preferred embodiments of the present invention, and that various changes and modification may be made thereto without departing from the spirit and scope thereof.

What is claimed is:

1. A connector comprising:

a plurality of connector modules, each of said connector modules including a plate-shaped holding member, a plurality of first contacts held on a first surface of said holding member, and a plurality of second contacts held on a second surface of said holding member, wherein positions of respective associated ones of said first and second contacts of said connector modules are approximately coincident with each other in a height direction of said housing; and a housing that holds said plurality of connector modules such that said plurality of connector modules are arranged with a gap between adjacent ones of said plurality of connector modules;

wherein said housing includes a plurality of partition walls that divide an inner space of said housing into a plurality of slots into which portions of respective ones of said connector modules are inserted, and wherein spaces formed in said partition walls are located between portions of said first contacts of a first one of said connector modules, and corresponding portions of said second contacts of a second one of said connector modules, said first and second connector modules being adjacent to each other in a direction of arrangement of said connector modules.

2. A connector as claimed in claim 1, wherein said first and second contacts are both signal contacts, wherein first ground contacts are each held between adjacent ones of said first contacts on the first surface of said holding member, and wherein second ground contacts are each held between adjacent ones of said second contacts on the second surface of said holding member.

3. A connector as claimed in claim 1, wherein each of said first contacts held on the first surface of said holding member and an associated one of said second contacts held on the second surface of said holding member form a pair of differential signal transmission contacts.

4. A connector as claimed in claim 2, wherein each of said first contacts held on the first surface of said holding member and an associated one of said second contacts held on the second surface of said holding member form a pair of differential signal transmission contacts.

5. A connector comprising:

a plurality of connector modules, each of said connector modules including a plate-shaped holding member, a plurality of first contacts held on a first surface of said holding member, and a plurality of second contacts held on a second surface of said holding member, wherein positions of respective associated ones of said first and second contacts of said connector modules are approximately coincident with each other in a height direction of said housing; and a housing that holds said plurality of connector modules such that said plurality of connector modules are arranged with a gap between adjacent ones of said plurality of connector modules;

wherein said housing includes a plurality of partition walls that divide an inner space of said housing into a plurality of slots into which portions of said connector modules are inserted, and gaps are provided between said partition walls and said first and second contacts of the connector modules;

wherein said first and second contacts are both signal contacts, wherein first ground contacts are each held between adjacent ones of said first contacts on the first surface of said holding member, and wherein second ground contacts are each held between adjacent ones of said second contacts on the second surface of said holding member.

6. A connector as claimed in claim 5, wherein each of said first contacts held on the first surface of said holding member and an associated one of said second contacts held on the second surface of said holding member form a pair of differential signal transmission contacts.

* * * * *